US008973543B2

(12) United States Patent
Hayashi

(10) Patent No.: US 8,973,543 B2
(45) Date of Patent: Mar. 10, 2015

(54) VALVE TIMING CONTROLLER AND ASSEMBLING METHOD OF THE SAME

(71) Applicant: Denso Corporation, Kariya, Aichi-pref. (JP)

(72) Inventor: Masashi Hayashi, Okazaki (JP)

(73) Assignee: Denso Corporation, Kariya (JP)

( * ) Notice: Subject to any disclaimer, the term of this patent is extended or adjusted under 35 U.S.C. 154(b) by 66 days.

(21) Appl. No.: 13/717,775

(22) Filed: Dec. 18, 2012

(65) Prior Publication Data

US 2013/0192551 A1 Aug. 1, 2013

(30) Foreign Application Priority Data

Jan. 26, 2012 (JP) ..... 2012-14060

(51) Int. Cl.
*F01L 1/34* (2006.01)
*F01L 1/344* (2006.01)

(52) U.S. Cl.
CPC ..... *F01L 1/344* (2013.01); *F01L 1/3442* (2013.01); *F01L 2001/3443* (2013.01); *F01L 2001/34433* (2013.01)
USPC ..... 123/90.17

(58) Field of Classification Search
USPC ..... 123/90.15, 90.17; 29/888.1; 137/855, 137/512.1, 512.15
See application file for complete search history.

(56) References Cited

U.S. PATENT DOCUMENTS 6,941,913 B2 9/2005 Smith
7,047,918 B1 * 5/2006 Polimeni, Jr. ..... 123/73 V
8,695,550 B2 * 4/2014 Ikuma ..... 123/90.17
2003/0196627 A1 * 10/2003 Lewis et al. ..... 123/90.17
2006/0086332 A1 * 4/2006 Simpson et al. ..... 123/90.17
2010/0313835 A1 12/2010 Yamaguchi et al.
2011/0168113 A1 * 7/2011 Busse et al. ..... 123/90.17
2011/0247576 A1 * 10/2011 Knecht et al. ..... 123/90.17
2011/0259289 A1 * 10/2011 Fujiyoshi ..... 123/90.15
2013/0133599 A1 * 5/2013 Ikuma ..... 123/90.17
2013/0199477 A1 * 8/2013 Schafer et al. ..... 123/90.17

FOREIGN PATENT DOCUMENTS

CN 1508400 A 6/2004
CN 102119263 A 7/2011
JP 3-217613 9/1991
JP 11-013430 1/1999
JP 2003-314229 11/2003
JP 2010-255576 11/2010
JP 2010-285986 12/2010
JP 2011-196245 10/2011

OTHER PUBLICATIONS

Chinese Office Action issued in Chinese Patent Application No. 201310004318.2 dated Sep. 28, 2014.

* cited by examiner

*Primary Examiner* — Thomas Denion
*Assistant Examiner* — Steven D Shipe
(74) *Attorney, Agent, or Firm* — Nixon & Vanderhye P.C.

(57) ABSTRACT

A valve timing controller includes a reed valve interposed between an end surface of a vane rotor and an end surface of a driven shaft. The reed valve has a fixed part, a first reed part and a second reed part. Each of the first reed part and the second reed part has each lower limit pressure for allowing working oil to flow from a first supply passage to a second supply passage. The lower limit pressure of the first reed part is different from the lower limit pressure of the second reed part.

4 Claims, 11 Drawing Sheets

VALVE TIMING CONTROLLER AND ASSEMBLING METHOD OF THE SAME

CROSS REFERENCE TO RELATED APPLICATION

This application is based on Japanese Patent Application No. 2012-14060 filed on Jan. 26, 2012, the disclosure of which is incorporated herein by reference in its entirety.

TECHNICAL FIELD

The present disclosure relates to a valve timing controller and an assembling method of the valve timing controller.

BACKGROUND

A valve timing controller controls opening and closing timing of an intake valve or an exhaust valve in an internal combustion engine by changing a rotation phase between a crankshaft and a camshaft. The valve timing controller has a housing rotating with the crankshaft, and a vane rotor rotating with the camshaft. The valve timing controller controls the valve timing by supplying working oil to an advance chamber or a retard chamber defined in the housing, so as to rotate the vane rotor. JP-2003-314229A (US 2003/0196627) describes a check valve system in which a reed valve is disposed in an oil passage which supplies the working oil to the advance chamber and the retard chamber as a check valve.

If a cross-sectional area of the oil passage connected to the reed valve is made smaller, the valve opening speed of the reed valve is made faster. However, in this case, a large pressure loss is generated when a large amount of the working oil is made to flow the oil passage, so the responsivity becomes worse because the relative rotation speed of the vane rotor cannot be raised.

In contrast, if the cross-sectional area of the oil passage is made larger, the valve opening speed of the reed valve becomes slow when a small amount of the working oil is made to flow the oil passage. In this case, the reed valve cannot work as the check valve and the responsivity becomes worse.

SUMMARY

It is an object of the present disclosure to provide a valve timing controller which accurately works even when a flow rate of working oil is varied. It is another object of the present disclosure to provide an assembling method of the valve timing controller.

According to an example of the present disclosure, a valve timing controller controls opening and dosing timing of an intake valve or an exhaust valve in an internal combustion engine by controlling a rotation phase between a driving shaft and a driven shaft. The valve timing controller includes a first housing, a second housing, a vane rotor, a sleeve, a spool and a reed valve. The first housing integrally rotates with the driving shaft and has a through hole through which the driven shaft passes. The second housing integrally rotates with the driving shaft and the first housing and has a pipe part and a bottom part. The first housing closes a first end of the pipe part, and the bottom part closes a second end of the pipe part. The vane rotor integrally rotates with the driven shaft and has a boss part and a vane part. The boss part is located inside the second housing. The vane part partitions inside of the second housing into an advance chamber and a retard chamber. The vane rotor rotates on an advance side or a retard side relative to the second housing based on a pressure of working oil in the advance chamber and the retard chamber.

A plurality of first supply passages is defined in the driven shaft and opens in an end surface of the driven shaft adjacent to the vane rotor. A plurality of second supply passages is defined in the vane rotor and opens in an end surface of the vane rotor adjacent to the first housing. The second supply passages respectively communicate with the first supply passages.

The sleeve has a cylindrical shape arranged on an inner side from the boss part in a radial direction. The sleeve has a supply port communicating with the second supply passage, an advance port communicating with the advance chamber, and a retard port communicating with the retard chamber. The spool slidably moves in the sleeve in an axial direction among an advance position at which the supply port is connected to the advance port, a retard position at which the supply port is connected to the retard port, and a shutoff position at which the supply port is shutoff from the advance port and the retard port.

The reed valve is interposed between the end surface of the vane rotor and the end surface of the driven shaft, and has a fixed part and a plurality of reed parts. The fixed part has a plurality of holes that respectively connect the first supply passages to the corresponding second supply passages. Each of the reed parts is formed to extend from an edge of the corresponding hole to cover the corresponding hole so as to open or close an open end of the corresponding first supply passage. The reed valve allows the working oil to flow from the first supply passage to the second supply passage and prohibits the working oil from flowing from the second supply passage to the first supply passage.

The plurality of reed parts includes at least a first reed part and a second reed part. Each of the first reed part and the second reed part has each lower limit pressure for allowing the working oil to flow from the first supply passage to the second supply passage. The lower limit pressure of the first reed part is different from the lower limit pressure of the second reed part.

Accordingly, the valve timing controller can accurately work even when a flow rate of working oil is varied.

Specifically, when the working oil flows with a small flow rate, which does not fill all the first supply passages and the second supply passage, at least one set of the first supply passage and the second supply passage are connected with each other to allow the working oil to flow. Thus, the working oil can be securely supply to the sleeve. When the working oil flows with a large flow rate, the working oil can be supplied to the sleeve using all the first supply passages and the second supply passage, so the valve timing of the intake valve or the exhaust valve can be quickly controlled.

According to an example of the present disclosure, a method of assembling the valve timing controller includes: attaching the reed valve to the first housing to agree with the through hole of the first housing; attaching the second housing, which receives the vane rotor inside, to the first housing; and inserting an end portion of the driven shaft into the through hole of the first housing in a manner that the reed valve is interposed between the end surface of the vane rotor and the end surface of the driven shaft. The attaching of the reed valve, the attaching of the second housing, and the inserting are conducted in this order. The second reed part before the inserting is inclined relative to the read valve toward the end surface of the driven shaft.

Accordingly, the valve timing controller can accurately work even when a flow rate of working oil is varied.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
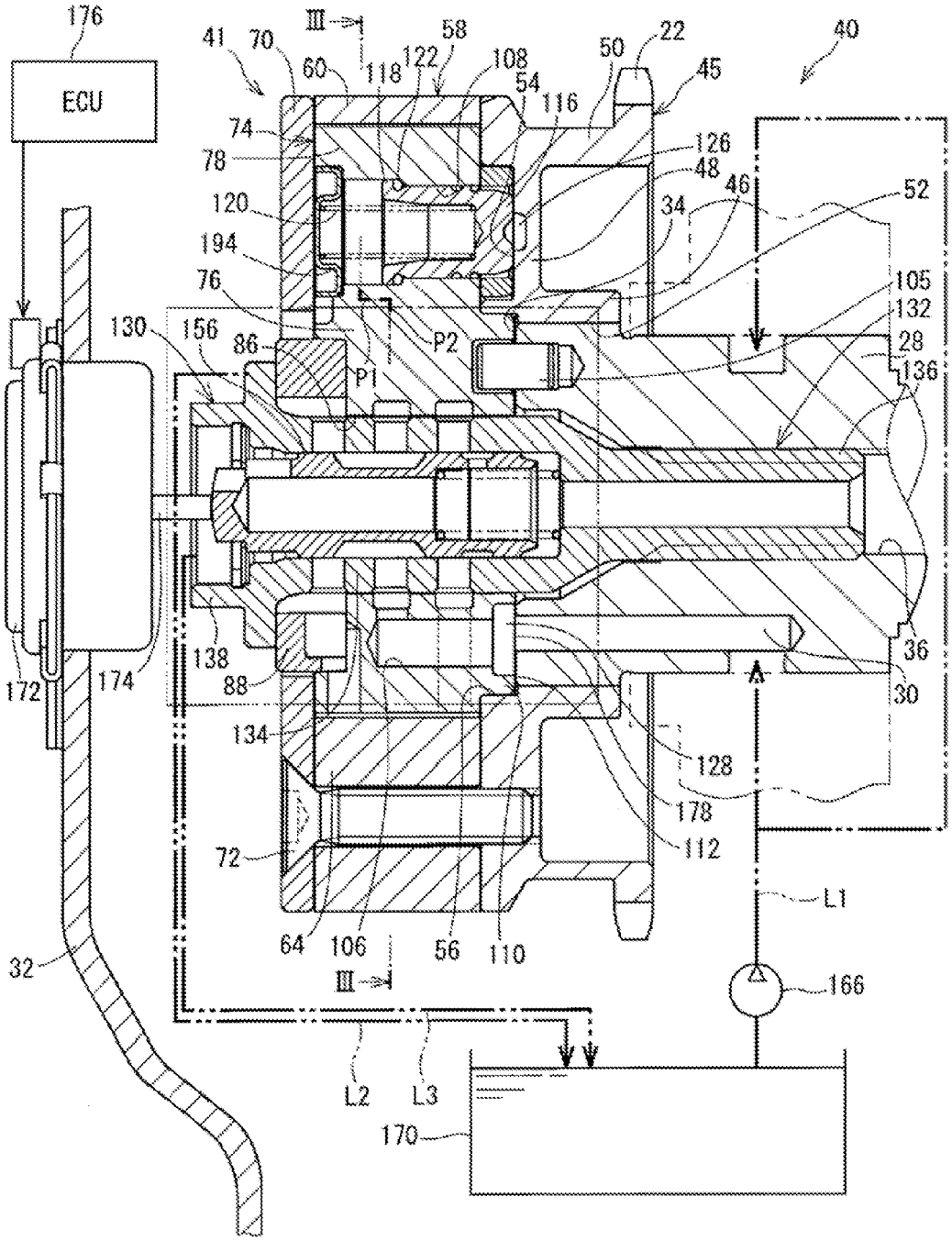
FIG. 1 is a schematic view illustrating a valve timing controller according to a first embodiment.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

(First Embodiment)

Figure 2:
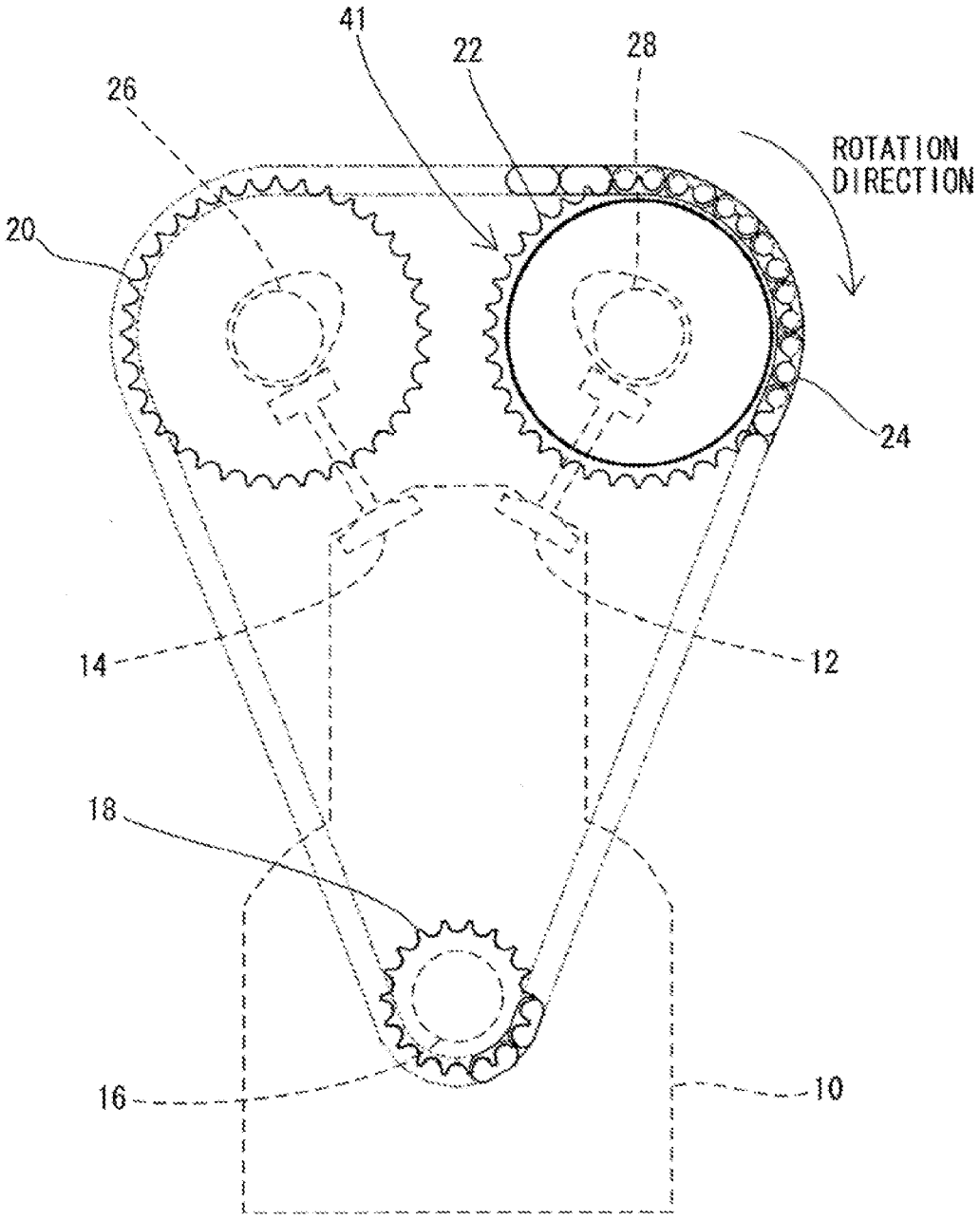
FIG. 2 is a schematic view illustrating an internal combustion engine having the valve timing controller.

A valve timing controller 41 according to a first embodiment is used in a valve timing control system 40 shown in FIG. 1. The valve timing control system 40 controls opening and closing timing of an intake valve 12 of an internal combustion engine 10 shown in FIG. 2. The intake valve 12 is rotated by a camshaft 28, and an exhaust valve 14 is rotated by a camshaft 26. Rotation of a gear 18 of a crankshaft 16 of the engine 10 is transmitted to gears 20, 22 through a chain 24.

The valve timing control system 40 advances the opening and closing timing of the intake valve 12 by rotating the camshaft 28 ahead in a rotation direction relative to the gear 22 rotating with the crankshaft 16.

The valve timing control system 40 retards the opening and closing timing of the intake valve 12 by rotating the camshaft 28 opposite from the rotation direction relative to the gear 22 rotating with the crankshaft 16.

Figure 3:
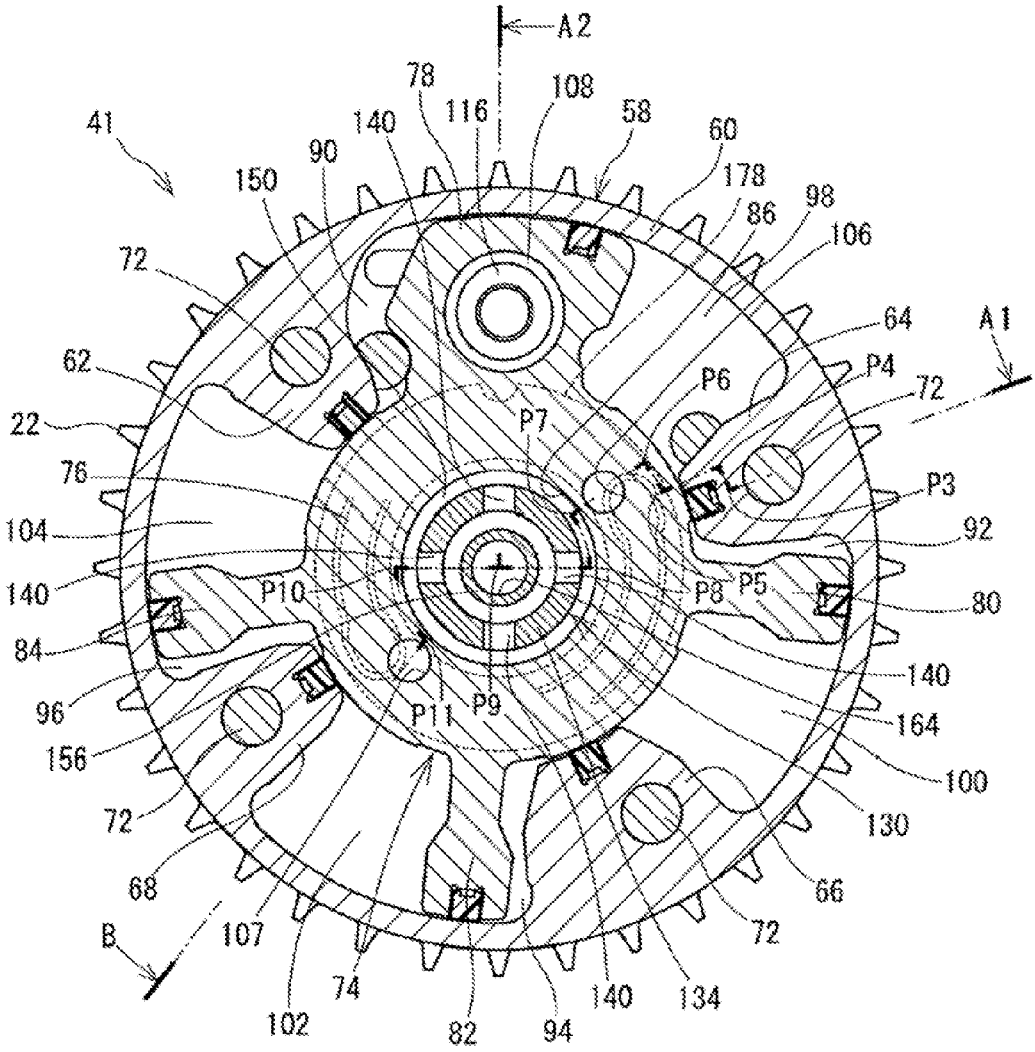
FIG. 3 is a cross-sectional view taken along a line III-P1-P2-III of FIG. 1.

The valve timing control system 40 is explained with reference to FIGS. 1, 3 and 4. FIG. 1 is a cross-sectional view taken along a line A1-P3-P4-P5-P6-P7-P8-P9-A2 of FIG. 3. As shown in FIG. 1, the valve timing control system 40 includes an oil pump 166, a motor cylinder 172, an electronic control unit (ECU) 176 in addition to the valve timing controller 41. A double chain line L1 of FIG. 1 represents a flow of working oil from an oil pan 170 and the oil pump 166 to the valve timing controller 41. A double chain line L2 and a double chain line L3 of FIG. 1 represent a flow of working oil from the valve timing controller 41 to the oil pan 170.

The valve timing controller 41 has a sprocket 45, a shoe housing 58, a front plate 70, a vane rotor 74, and a passage switching valve 130. The sprocket 45 may correspond to a first housing. The shoe housing 58 may correspond to a pipe part. The front plate 70 may correspond to a bottom part. The shoe housing 58 and the front plate 70 may construct a second housing.

Rotation of the crankshaft 16 is transmitted to the gear 22 of the sprocket 45 through the chain 24. The sprocket 45, the shoe housing 58, and the front plate 70 are integrally combined with each other, and integrally rotate with the crankshaft 16. The sprocket 45, the shoe housing 58, and the front plate 70 define a rotor accommodation space that accommodates the vane rotor 74.

The vane rotor 74 is integrally combined with the camshaft 28 by a lock pin 105, and integrally rotates with the camshaft 28. The rotor accommodation space has advance chambers 90, 92, 94, 96 (hereinafter referred as 90-96) and retard chambers 98, 100, 102, 104 (hereinafter referred as 98-104), and the vane rotor 74 receives pressure of working oil supplied to the advance chambers 90-96 or the retard chambers 98-104 so as to rotate on the advance side or the retard side relative to the shoe housing 58.

The passage switching valve 130 switches supply passages 106, 107 inside of the vane rotor 74 to communicate with the advance chambers 90-96 or the retard chambers 98-104. The vane rotor 74 has a convex portion 110, and openings 128, 129 are defined in a tip end surface 112 of the convex portion 110. The supply passage 106 communicates with a supply passage 30 defined inside of the camshaft 28 through the opening 128. The supply passage 107 communicates with a supply passage 31 defined inside of the camshaft 28 through the opening 129. The opening 128, 129 may correspond to a second supply passage. The passage switching valve 130 is operated by the motor cylinder 172.

The oil pump 166 pumps working oil from the oil pan 170, and supplies the working oil to the passage switching valve 130 via the supply passage 30, the opening 128, and the supply passage 106. The working oil is supplied to the passage switching valve 130 also via the supply passage 31, the opening 129, and the supply passage 107. That is, the valve timing controller 41 has two systems for supplying the working oil to the passage switching valve 130. The supply passage 30, 31 may correspond to a first supply passage.

The motor cylinder 172 may be an electromagnetic type cylinder, and, as shown in FIG. 1, the motor cylinder 172 is attached to an engine cover 32. The motor cylinder 172 is arranged to have the same axis as a spool 156 of the passage switching valve 130. The motor cylinder 172 has a rod 174 and a solenoid (not shown). The rod 174 reciprocates in an axial direction. The solenoid is arranged on the outer side of the rod 174 in a radial direction. The rod 174 moves in the axial direction according to a magnetic field generated by the solenoid when the solenoid is energized. The rod 174 presses the spool 156 of the passage switching valve 130 in the axial direction.

The electronic control unit 176 drives the motor cylinder 172 in a manner that the rotation phase of the vane rotor 74 relative to the shoe housing 58 agrees with a target rotation phase. Specifically, when the rotation phase is on the retard side from the target rotation phase, the electronic control unit 176 controls the axial position of the spool 156 of the passage switching valve 130 in a manner that working oil is supplied to the advance chambers 90-96. Moreover, when the rotation phase is on the advance side from the target rotation phase, the electronic control unit 176 controls the axial position of the spool 156 of the passage switching valve 130 in a manner that working oil is supplied to the retard chambers 98-104. Moreover, when the rotation phase agrees with the target rotation phase, the electronic control unit 176 controls the axial position of the spool 156 of the passage switching valve 130 in a manner that the advance chambers 90-96 and the retard chambers 98-104 of the valve timing controller 41 are separated from the supply passage 106, 107 and a discharge passage.

The valve timing controller 41 will be specifically described.

The sprocket 45 integrally has an inner cylinder portion 46, a flange portion 48 and an outer cylinder portion 50. The inner cylinder portion 46 is fitted to an outer circumference wall of a first end part of the camshaft 28. The flange portion 48 is projected from the inner cylinder portion 46 outward in the radial direction. The outer cylinder portion 50 extends from the outer circumference of the flange portion 48 toward a second end part of the camshaft 28. The inner cylinder portion 46 has a through hole 52 through which the camshaft 28 passes. The outer cylinder portion 50 has the gear 22.

The shoe housing 58 has a pipe part 60 and plural shoe parts 62, 64, 66, 68. A first end of the pipe part 60 is closed by the sprocket 45, and the plural shoe parts 62, 64, 66, 68 are projected inward in the radial direction from the pipe part 60. The shoe parts 62, 64, 66, 68 are arranged to be distanced from each other in the circumference direction of the pipe part 60.

The front plate 70 is a ring board member which doses a second end of the pipe part 60. The sprocket 45, the shoe housing 58, and the front plate 70 are integrally combined with each other using plural bolts 72.

The vane rotor 74 has a boss part 76 and plural vane parts 78, 80, 82, 84. The boss part 76 is located on the inner side from the shoe parts 62, 64, 686, 68 in the radial direction, and the plural vane parts 78, 80, 82, 84 are projected outward in the radial direction from the boss part 76. The vane rotor 74 is rotated relative to the sprocket 45, the shoe housing 58, and the front plate 70.

The boss part 76 has a first fitting hole 86 to which a sleeve part 134 of a sleeve bolt 132 is fitted. A center washer 88 is fitted to the boss part 76 at a position opposing to the front plate 70. The vane rotor 74 and the camshaft 28 are integrally combined with each other by the sleeve bolt 132 which passes through the center washer 88 and the vane rotor 74 to be tightened to the camshaft 28.

Four vane accommodation chambers are defined between the boss part 76 of the vane rotor 74 and the pipe part 60 of the shoe housing 58, and are divided by the shoe parts 62, 84, 66, 68. Each of the vane accommodation chambers accommodates the vane part 78, 80, 82, 84 in a manner that the vane part 78, 80, 82, 84 is relatively rotatable within a predetermined angle range. In FIG. 3, a clockwise rotation direction represents an advance direction, and a counterclockwise rotation direction represents a retard direction. The vane accommodation chamber is divided into the advance chamber 90, 92, 94, 96 and the retard chamber 98, 100, 102, 104 by the vane part 78, 80, 82, 84.

The vane part 78 of the vane rotor 74 has a receiving hole 108 penetrated in the axial direction as a through hole. The receiving hole 108 has a first part adjacent to the front plate 70 and a second part adjacent to the sprocket 45, and an inside diameter of the first part is larger than that of the second part through a step part. A lock pin 116 is received in the receiving hole 108 in a manner that the lock pin 116 reciprocates in the axial direction. The lock pin 116 is slidably movable relative to an inner wall of the second part of the receiving hole 108, and has a flange 118 projected outward in the radial direction inside of the first part of the receiving hole 108. The lock pin 116 is biased toward the sprocket 45 by a first spring 120 that is arranged adjacent to the front plate 70.

When the vane rotor 74 is located at an optimal position optimal for an engine start, the lock pin 116 is able to be fitted to a fitting concave portion 54 defined in the sprocket 45 adjacent to the vane rotor 74. The lock pin 116 regulates the relative rotation of the vane rotor 74 relative to the shoe housing 58 by fitting to the fitting concave portion 54 at the optimal position. In the first embodiment, the optimal position is set as the maximum retard position of the vane rotor 74, and the fitting concave portion 54 is formed to correspond to the lock pin 116 in a case where the vane rotor 74 is located at the maximum retard position.

A first unlock chamber 122 is defined to extend from the flange 118 of the lock pin 116 toward the sprocket 45. The first unlock chamber 122 is communicated with the advance chamber 90 via a passage (not shown). Moreover, a second unlock chamber 126 is defined between the lock pin 116 and the sprocket 45. The second unlock chamber 126 is communicated with the retard chamber 98 via a passage (not shown).

The pressure of the working oil supplied to the first unlock chamber 122 through the advance chamber 90 and the pressure of the working oil supplied to the second unlock chamber 126 through the retard chamber 98 act in a manner that the lock pin 116 comes out of the fitting concave portion 54. It is determined by a balance between the biasing force of the first spring 120 and the difference in the pressure of the working oil between the first unlock chamber 122 and the second unlock chamber 126 whether the vane rotor 74 is held at the optimal position by the lock pin 116.

The passage switching valve 130 has the sleeve bolt 132 and the spool 156. The sleeve bolt 132 integrally has the sleeve part 134, a thread part 136, and a head part 138 as a sleeve. The sleeve part 134 has a cylindrical shape, and is fitted with the first fitting hole 86 of the boss part 76 of the vane rotor 74 by passing through the center washer 88. The sleeve part 134 has a supply port 140, an advance port 144 and a retard port 148. The supply port 140 communicates with the supply passages 106, 107. The advance port 144 communicates with the advance chambers 90-96 via an advance passage 142 defined inside of the vane rotor 74. The retard port 148 communicates with the retard chambers 98-104 via a retard passage 146 defined inside of the vane rotor 74.

The supply port 140 is defined, for example, at four positions arranged in the circumference direction, and communicates with the supply passage 106, 107 via a first annular groove 150 defined in the inner wall of the first fitting hole 86. Moreover, the advance port 144 is defined, for example, at four positions arranged in the circumference direction, and communicates with the advance passage 142 via a second annular groove 152 defined in the inner wall of the first fitting hole 86. Moreover, the retard port 148 is defined, for example, at four positions arranged in the circumference direction, and communicates with the retard passage 146 via an annular oil passage 154 defined on the inner side from the center washer 88 in the radial direction.

The thread part 136 extends toward the camshaft 28 from the sleeve part 134, and is coupled to a tapped hole 36 defined in an end surface 34 of the camshaft 28.

The head part 138 has a cylindrical shape having the same axis as the sleeve part 134. The sleeve part 134 is located between the thread part 136 and the head part 138. The head part 138 has an outside diameter larger than that of the sleeve part 134.

The spool 156 is located on the inner side from the sleeve part 134 and the head part 138 in the radial direction. The spool 156 has a cylindrical shape having the same axis as the sleeve part 134. The spool 156 is slidably movable relative to the inner wall of the sleeve part 134 in the axial direction. The spool 158 is biased toward the front plate 70 by a second spring 157 which is arranged adjacent to the sprocket 45. The axial position of the spool 156 is determined by a balance between the biasing force of the second spring 157 and the thrust force of the rod 174 of the motor cylinder 172.

Figure 6:
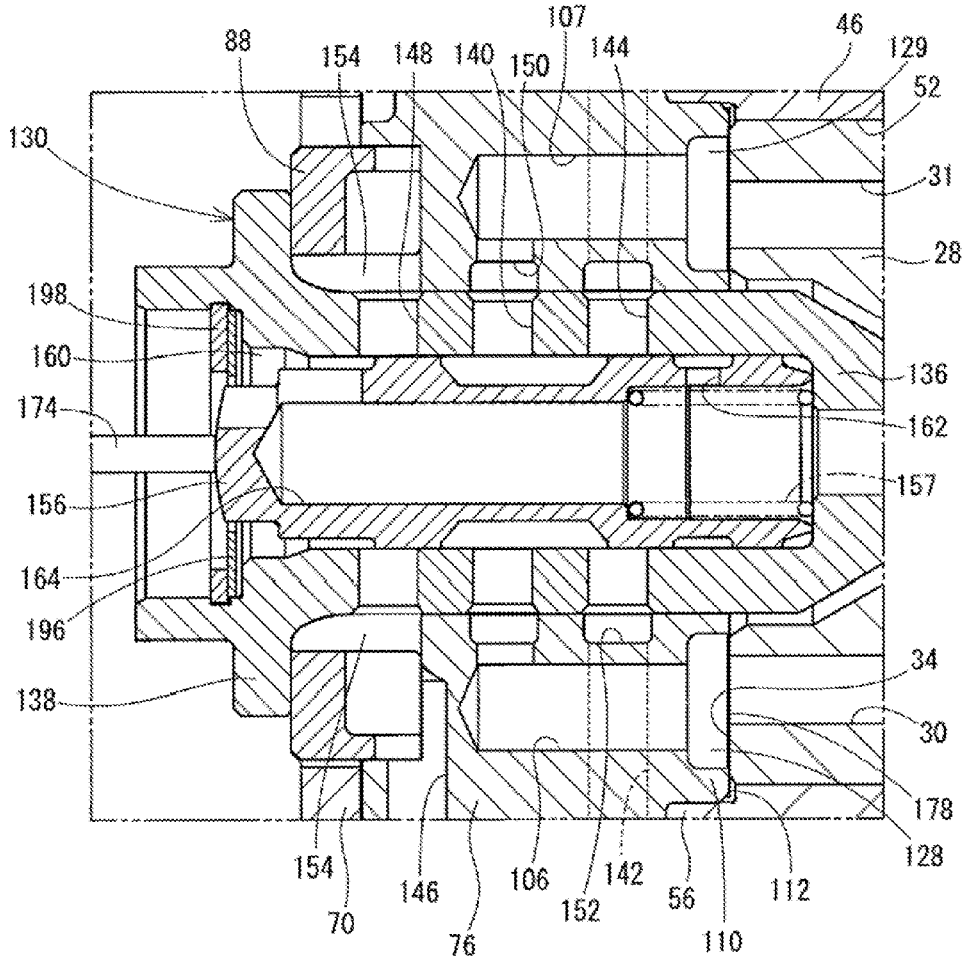
FIG. 6 is an enlarged cross-sectional view of a section defined by a single chain line of FIG. 1 in which a spool is located at an advance position.

FIG. 6 illustrates the spool 156 located at an advance position. The spool 156 is made to contact the thread part 136. The spool 156 located at the advance position connects the supply port 140 to the advance port 144, and disconnects the supply port 140 from the retard port 148. At this time, the working oil of the retard chambers 98-104 is discharged outside via the retard passage 146, the annular oil passage 154, the retard port 148, and a passage 160 defined between the sleeve bolt 132 and the spool 156. The passage 160 may be equivalent to the above-mentioned discharge passage.

Figure 7:
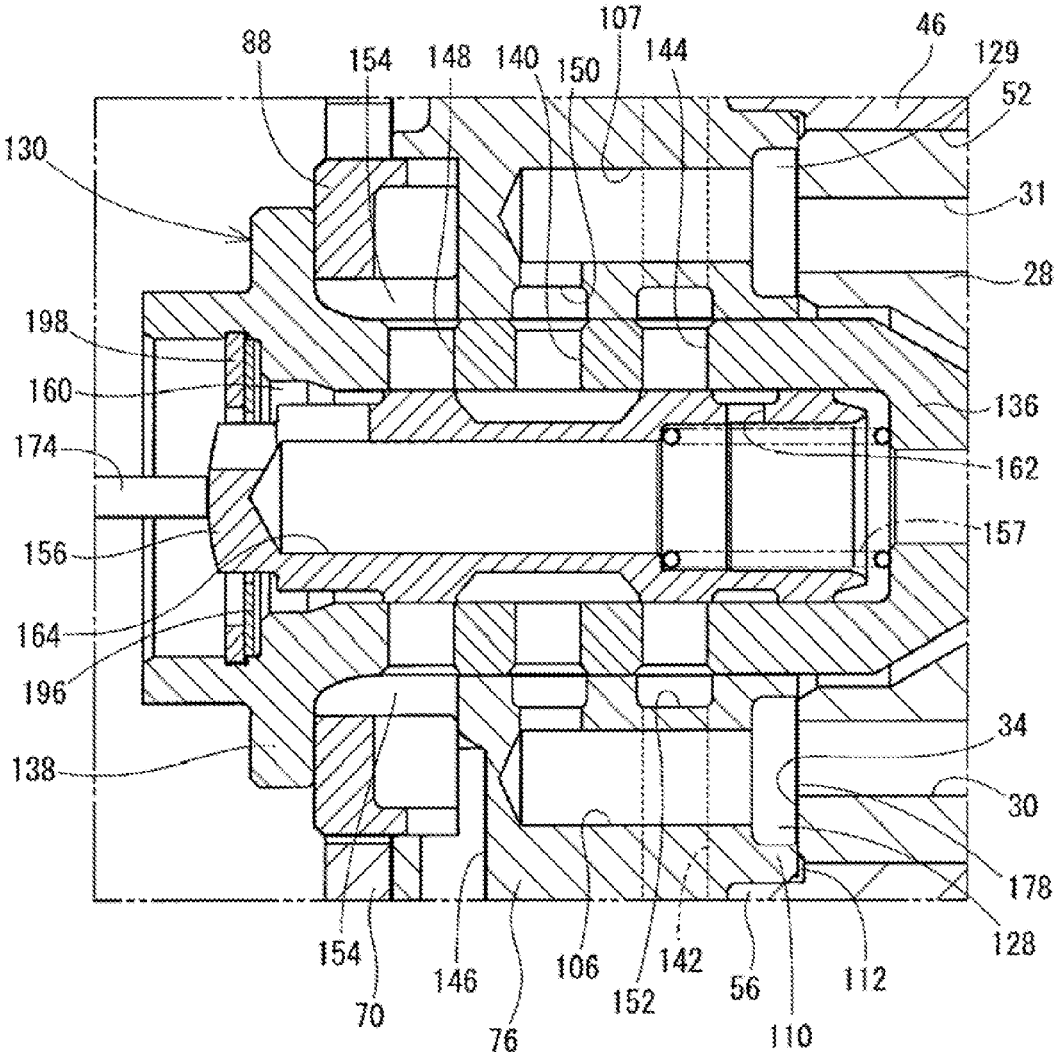
FIG. 7 is an enlarged cross-sectional view of the section defined by a single chain line of FIG. 1 in which a spool is located at a shutoff position.

FIG. 7 illustrates the spool 156 located at a shutoff position. The radially outer surface of the spool 156 located at the shutoff position closes the advance port 144 and the retard port 148, thereby shutting off the supply port 140 of the sleeve part 134 from the advance port 144 and the retard port 148.

Figure 8:
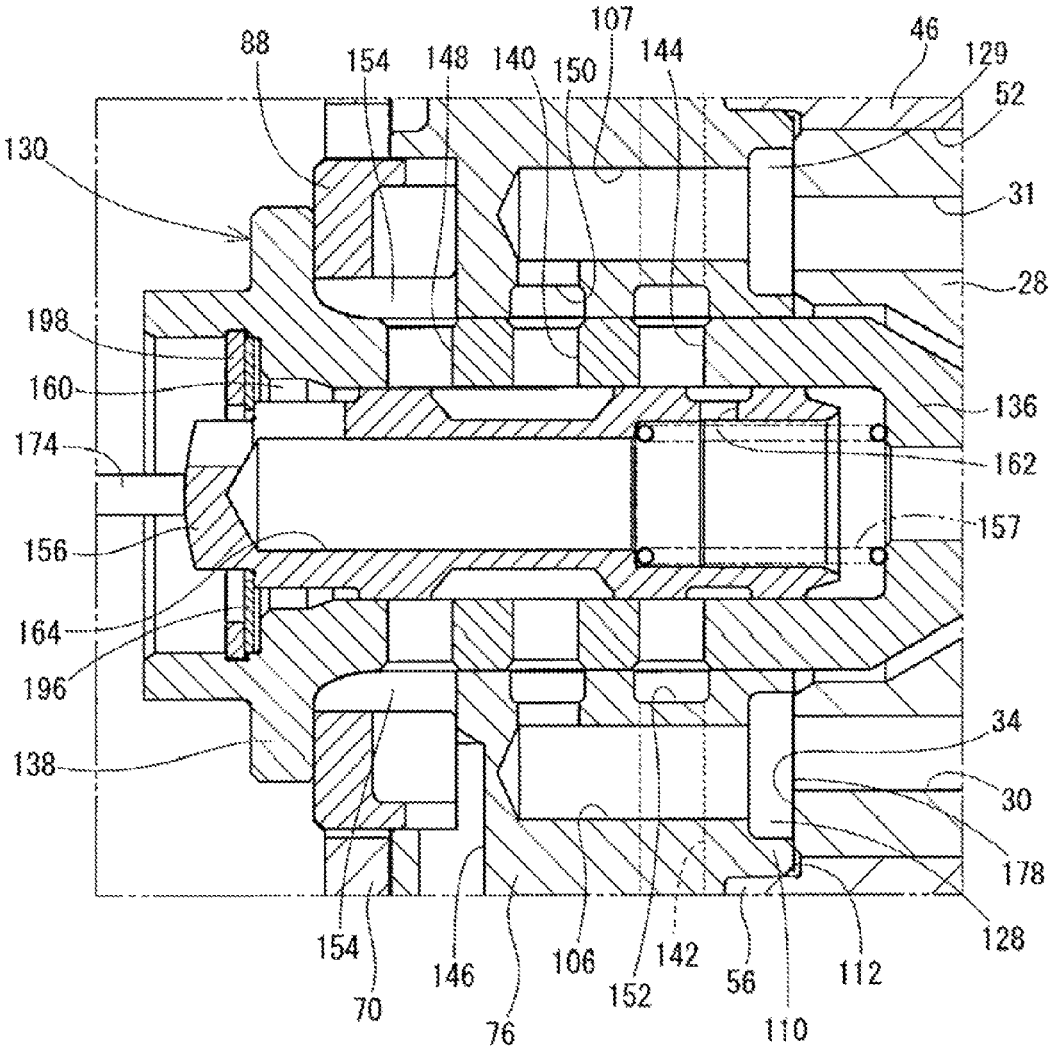
FIG. 8 is an enlarged cross-sectional view of the section defined by a single chain line of FIG. 1 in which a spool is located at a retard position.

FIG. 8 illustrates the spool 156 located at a retard position. The spool 156 is made to contact a stopper plate 196 that is fitted to the inner wall of the head part 138. The spool 156 located at the retard position connects the supply port 140 to the retard port 148, and disconnects the supply port 140 from the advance port 144. At this time, the working oil of the advance chambers 90-96 is discharged outside via the advance passage 142, the advance port 144, a hole 162 of the spool 156, and a radially inside passage 164 of the spool 156. The hole 162 and the radially inside passage 164 may be equivalent to the above-mentioned discharge passage.

The valve timing controller 41 includes a reed valve 178 which is described with reference to FIGS. 4, 5A and 5B.

The reed valve 178 is arranged between the end surface 112 of the convex portion 110 of the vane rotor 74 and the end surface 34 of the camshaft 28. The reed valve 178 has a fixed part 182, a first reed part 184 and a second reed part 185. The fixed part 182 has a first hole 180, a second hole 181 and a through hole 183. The supply passage 31 and the opening 129 are communicated with each other through the first hole 180. The supply passage 30 and the opening 128 are communicated with each other through the second hole 181. The sleeve part 134 passes through the through hole 183. The first reed part 184 extends inside of the first hole 180 to cover the first hole 180 from the edge of the first hole 180. The second reed part 185 extends inside of the second hole 181 to cover the second hole 181 from the edge of the second hole 181.

The reed valve 178 is a check valve which allows the working oil to flow from the supply passage 30, 31 to the opening 128, 129 and prohibits the working oil from flowing from the opening 128, 129 to the supply passage 30, 31.

The first reed part 184 integrally has a first lid part 186 and a first flexible part 188. The lid part 186 closes the supply passage 31 defined in the end surface 34. The flexible part 188 connects the lid part 186 to the fixed part 182. When the pressure of the working oil in the supply passage 31 acts on the lid part 186, the flexible part 188 bends in a manner that the lid part 186 is distanced from the open end of the supply passage 31.

The second reed part 185 integrally has a second lid part 187 and a second flexible part 189. The lid part 187 closes the supply passage 30 defined in the end surface 34. The flexible part 189 connects the lid part 187 to the fixed part 182. When the pressure of the working oil in the supply passage 30 acts on the lid part 187, the flexible part 189 bends in a manner that the lid part 187 is distanced from the open end of the supply passage 30.

At this time, a dimension D2 from the center of the second lid part 187 to a connection point at which the second flexible part 189 and the fixed part 182 are connected with each other is larger than a dimension D1 from the center of the first lid part 186 to a connection point at which the first flexible part 188 and the fixed part 182 are connected with each other. That is, a pressure necessary for opening the second reed part 185 is smaller than that for opening the first reed part 184. The pressure necessary for opening the reed part may correspond to a lower limit pressure for allowing the working oil to flow from the first supply passage to the second supply passage.

Next, procedure assembling components to produce the valve timing controller 41 and procedure fixing the valve timing controller 41 to the engine 10 are explained. The procedure manufacturing the valve timing controller 41 is explained with reference to FIGS. 1 and 4 which illustrate a finished product, for convenience.

The lock pin 116, the first spring 120, and a spring receptacle component 194 are attached to the vane rotor 74 at first. The spring receptacle component 194 is pressingly fitted into the vane rotor 74.

The reed valve 178 is arranged in the concave portion 56 of the sprocket 45. The vane rotor 74, the shoe housing 58, and the front plate 70 are arranged to the sprocket 45 in a manner that the convex portion 110 of the vane rotor 74 is fitted with the concave portion 56 of the sprocket 45, and are fastened using the bolt 72.

Figure 4:
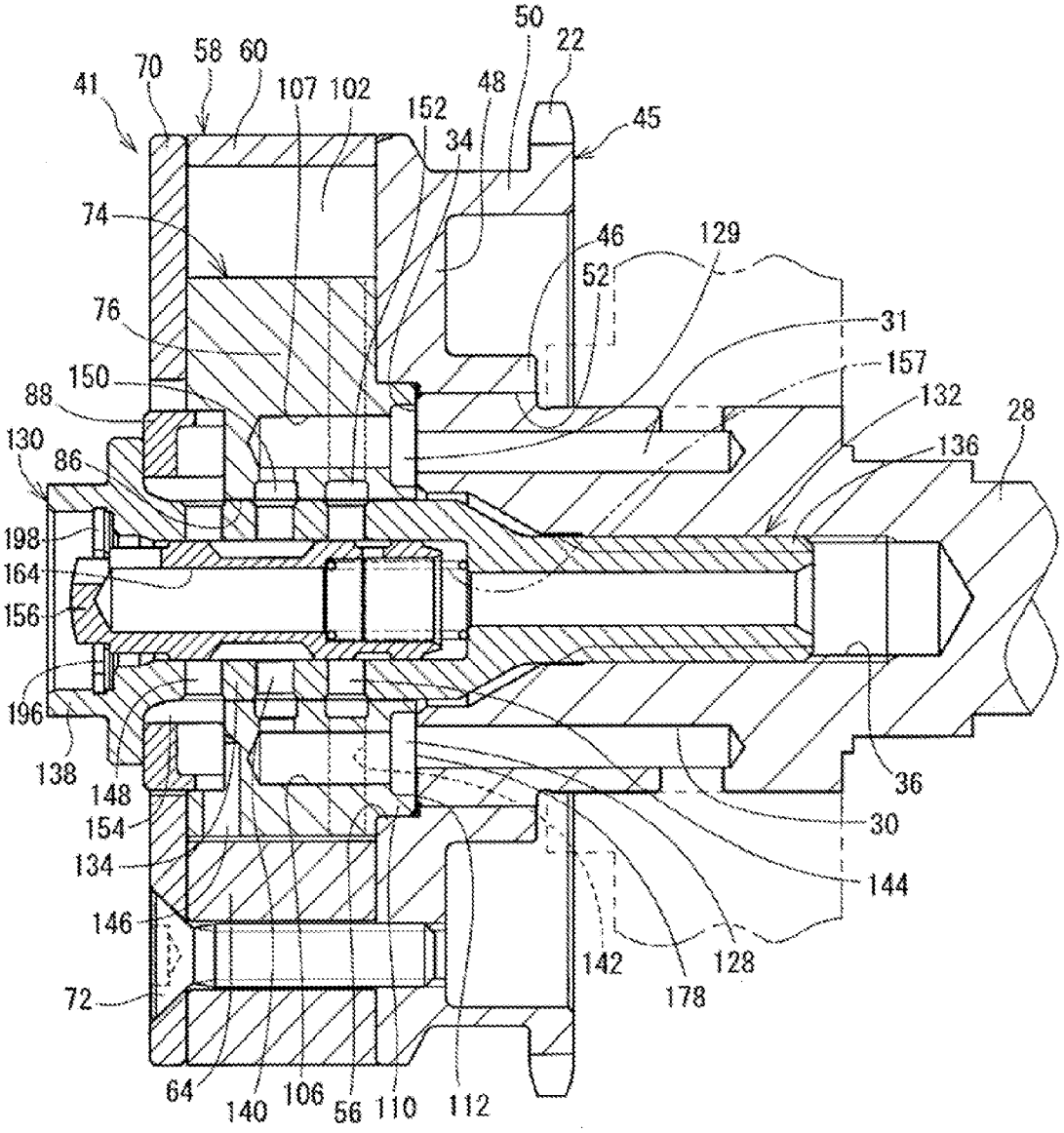
FIG. 4 is a cross-sectional view taken along a line A1-P3-P4-P5-P6-P7-P8-P9-P10-P11-B of FIG. 3.
Figure 5A:
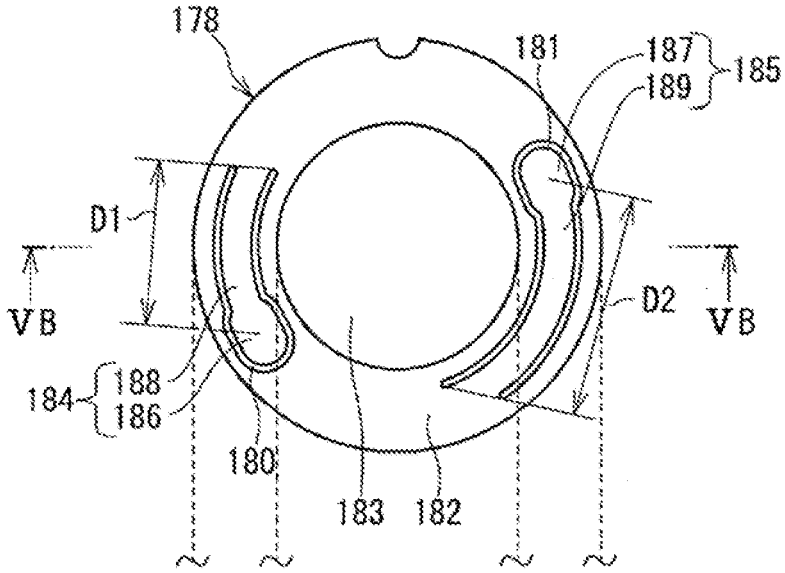
FIG. 5A is a schematic plan view illustrating a reed valve of the valve timing controller.
Figure 5B:
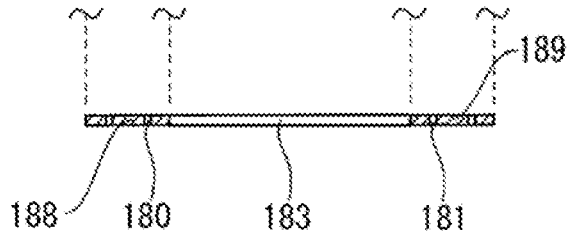
FIG. 5B is a cross-sectional view illustrating the reed valve.

Then, as shown in FIG. 4, the center washer 88 is fitted into the center section of the vane rotor 74, and a control pin (not shown) is pressingly fitted, for example.

The second spring 157, the spool 156, and the stopper plate 196 are arranged in the sleeve bolt 132, and a snap ring 198 is fitted with the inner wall of the head part 138, so as to restrict the spool 156 from slipping off. Thus, the assembling of the valve timing controller 41 is completed.

Thereafter, the valve timing controller 41 is attached to the engine 10. The end portion of the camshaft 28 is inserted into the through hole 52 of the sprocket 45, at first.

Then, the valve timing controller 41 is fixed to the camshaft 28 with the sleeve bolt 132, thus the valve timing controller 41 is completely attached to the engine 10.

Next, operation of the valve timing controller 41 will be explained in detail.

When the rotation phase of the vane rotor 74 relative to the shoe housing 58 is on the retard side from a target rotation phase, the spool 156 of the passage switching valve 130 is moved to the advance position shown in FIG. 6. As shown in FIG. 1, the working oil is supplied from the oil pump 166 via the supply passage 30, 31, the opening 128, 129, the supply passage 106, 107 and the first annular groove 150, to the supply port 140. The supplied oil flows into the advance chambers 90, 92, 94, 96 via the advance port 144 and the advance passage 142. On the other hand, the working oil of the retard chambers 98, 100, 102, 104 is discharged outside via the retard passage 146, the retard port 148, and the passage 160. Thus, the vane rotor 74 is advanced relative to the shoe housing 58.

Moreover, when the rotation phase of the vane rotor 74 relative to the shoe housing 58 is on the advance side from a target rotation phase, the spool 156 of the passage switching valve 130 is moved to the retard position shown in FIG. 8. As shown in FIG. 1, the working oil is supplied from the oil pump 166 via the supply passage 30, 31, the opening 128, 129, the supply passage 106, 107 and the first annular groove 150, to the supply port 140. The supplied oil flows into the retard chambers 98, 100, 102, 104 via the retard port 148 and the retard passage 146. On the other hand, the working oil of the advance chambers 90, 92, 94, 96 is discharged outside via the advance passage 142, the advance port 144, the hole 162 and the passage 164. Thereby, the vane rotor 74 is retarded relative to the shoe housing 58.

Moreover, when the rotation phase of the vane rotor 74 relative to the shoe housing 58 is in agreement with a target rotation phase, the spool 156 of the passage switching valve 130 is moved to the shutoff position shown in FIG. 7. At this time, the advance chambers 90, 92, 94, 96 are separated from the supply port 140 and the passage 164, and the retard chambers 98, 100, 102, 104 are separated from the supply port 140 and the passage 180. Thereby, the working oil stays in the advance chambers 90, 92, 94, 96 and the retard chambers 98, 100, 102, 104. As a result, the relative position of the vane rotor 74 does not change relative to the shoe housing 58.

When the working oil is supplied to the passage switching valve 130, the flow rate of the working oil supplied from the supply passage 30, 31 to the supply passage 106, 107 through the opening 128, 129 is fluctuated because the amount of the working oil discharged from the oil pump 16688 fluctuates periodically. The reed valve 178 restricts the working oil from flowing backward to the supply passage 30, 31 from the opening 128, 129. Thereby, the pressure of the working oil of the supply passage 106, 107, which communicates with the opening 128, 129, is restricted from declining while the working oil is supplied to each chamber. Therefore, the pressure of the working oil can be quickly raised in each chamber.

When working oil with a small flow rate is supplied to the supply passage 30, 31, the second reed part 185 is opened earlier than the first reed part 184 because the dimension D2 of the second flexible part 189 of the second reed part 185 is longer than the dimension D1 of the first flexible part 188 of the first reed part 184. Thereby, working oil is supplied to the passage switching valve 130, and the opening and closing timing of the intake valve 12 is controlled.

Moreover, when working oil with a large flow rate is supplied to the supply passage 30, 31, both of the first reed part 184 and the second reed part 185 are opened. Thereby, working oil is supplied to the passage switching valve 130, and the opening and closing timing of the intake valve 12 is controlled.

According to the first embodiment, the valve timing controller 41 has two supply passages (systems) which supply working oil to the passage switching valve 130. The reed valve 178 has the first reed part 184 and the second reed part 185 to correspond to the two supply passages. Because the dimension D2 is longer than the dimension D1, the spring constant of the second reed part 185 is smaller than the spring constant of the first reed part 184.

When working oil of a small flow rate is supplied, the second reed part 185 is opened earlier than the first reed part 185 because the spring constant of the second reed part 185 is smaller, and working oil is supplied to the passage switching valve 130. On the other hand, when working oil of a large flow rate is supplied, both of the first reed part 184 and the second reed part 185 are opened and working oil is supplied to the passage switching valve 130.

Thus, in the valve timing controller 41 of the first embodiment, when working oil of a large flow rate is supplied, the passage switching valve 130 can be maintained to have high switching speed for the passages. In contrast, when working oil of a small flow rate is supplied, the second reed part 185 having the small spring constant is opened, thereby working oil can be supplied to the passage switching valve 130 with reliability.

(Second Embodiment)

A second embodiment will be described with reference to FIGS. 9A and 9B. A reed valve 278 of the second embodiment is different from the reed valve 178 of the first embodiment. The substantially same parts and components as the first embodiment are indicated with the same reference numeral and the same description will not be reiterated.

Figure 9A:
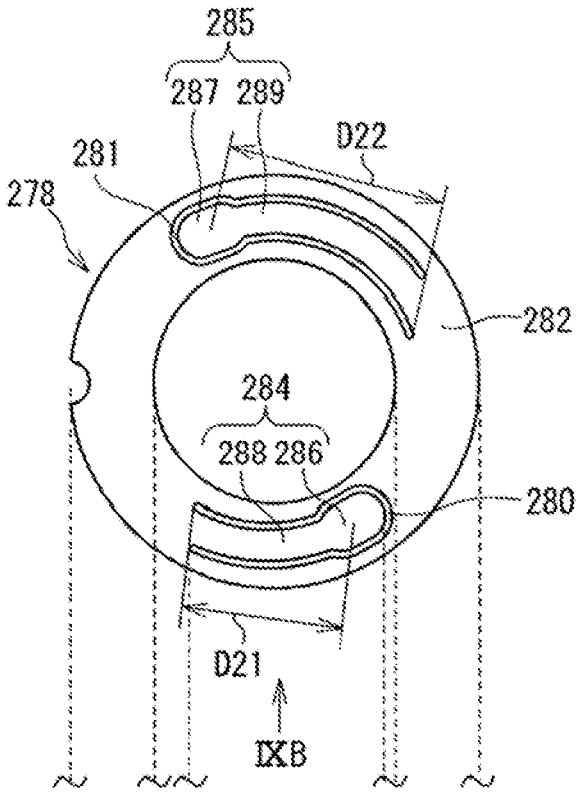
FIG. 9A is a schematic plan view illustrating a reed valve of a valve timing controller according to a second embodiment.
Figure 9B:
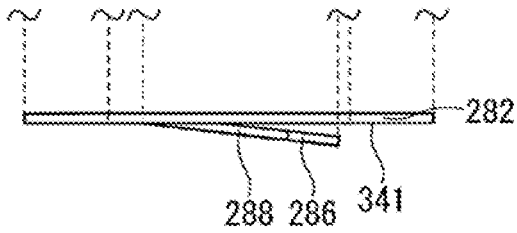
FIG. 9B is a side view illustrating the reed valve of the second embodiment.

FIG. 9A illustrates a plan view of the reed valve 278 used for the valve timing controller of the second embodiment. FIG. 9B illustrates a side view of the reed valve 278 before being mounted to the valve timing controller.

The reed valve 278 of the second embodiment has two reed parts, similarly to the reed valve 178 of the first embodiment. The reed valve 278 has a fixed part 282, a first reed part 284 and a second reed part 285. The fixed part 282 has a first hole 280 and a second hole 281. The first reed part 284 extends to cover the first hole 280 from the edge of the first hole 280. The second reed part 285 extends to cover the second hole 281 from the edge of the second hole 281.

The first reed part 284 integrally has a first lid part 286 and a first flexible part 288 which connects the first lid part 286 to the fixed part 282. Moreover, the second reed part 285 integrally has a second lid part 287 and a second flexible part 289 which connects the second lid part 287 to the fixed part 282.

A dimension D22 from the center of the second lid part 287 to a connection point at which the second flexible part 289 and the fixed part 282 are connected with each other is larger than a dimension D21 from the center of the first lid part 286 to a connection point at which the first flexible part 288 and the fixed part 282 are connected with each other.

The first reed part 284 is not located in the same plane as the fixed part 282 before the reed valve 278 is attached to the valve timing controller, that is, when the reed valve 278 is in the free state. Specifically, as shown in FIG. 9B, the first reed part 284 is formed to be inclined relative to a flat surface 341 of the reed valve 278.

A method of assembling the valve timing controller of the second embodiment will be described. Similarly to the first embodiment, in a first process, the reed valve 278 is arranged in the concave portion 56 of the sprocket 45. At this time, the reed valve 278 is attached in a manner that the opposite surface of the reed valve 278 opposite from the flat surface 341 will contact the tip end surface 112 of the vane rotor 74 in the following process.

Next, in a second process, the vane rotor 74, the shoe housing 58, and the front plate 70 are attached to the sprocket 45 in a manner that the convex portion 110 of the vane rotor 74 is fitted into the concave portion 56 of the sprocket 45, and are fastened with the bolt 72.

Then, the center washer 88 is inserted into the center section of the vane rotor 74, and the second spring 157, the spool 156, and the stopper plate 196 are arranged in the sleeve bolt 132. The snap ring 198 is fitted with the inner wall of the head part 138 so as to restrict the spool 156 from slipping off.

Next, in a third process, the end portion of the camshaft 28 is inserted into the through hole 52 of the sprocket 45. At this time, the reed valve 278 is interposed between the tip end surface 112 of the vane rotor 74 and the end surface 34 of the camshaft 28. Moreover, the flat surface 341 of the reed valve 278 is contacted with the end surface 34 of the camshaft 28, and the first reed part 284 is pressed into the same plane as the reed valve 278.

Then, the valve timing controller of the second embodiment is fixed to the camshaft 28 with the sleeve bolt 132, thus the attachment of the valve timing controller to the engine 10 is completed.

According to the second embodiment, the first reed part 284 is formed to be inclined toward the end surface 34 of the camshaft 28 before inserted between the tip end surface 112 and the end surface 34. Therefore, the spring constant of the first reed part 284 becomes larger than that the second reed part 285, so the pressure necessary for opening the first reed part 284 is larger that that for opening the second reed part 285. When working oil flows through the supply passages 30, 31, the second reed part 285 opens earlier than the first reed part 284, because the pressure necessary for opening the second reed part 285 is relatively smaller, and working oil is supplied to the passage switching valve 130. Therefore, the same advantages can be obtained in the second embodiment as the first embodiment.

(Third Embodiment)

Figure 10:
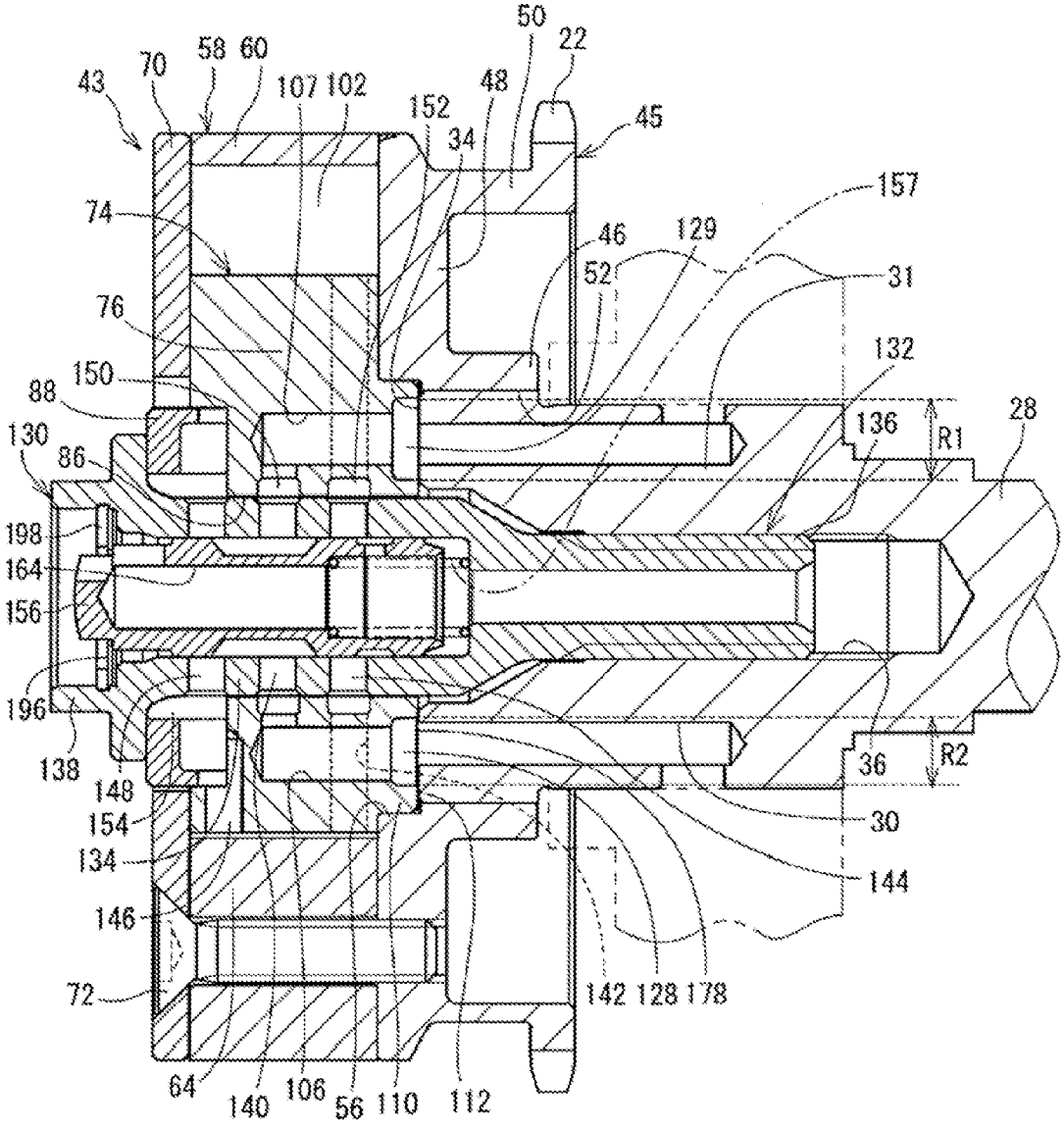
FIG. 10 is a cross-sectional view illustrating a part of a valve timing controller according to a third embodiment.

A valve timing controller 43 according to a third embodiment will be described with reference to FIG. 10. In the third embodiment, compared with the first embodiment, the inside diameter R2 of the opening 128 is made different from the inside diameter R1 of the opening 129. The substantially same parts and components as the first embodiment are indicated with the same reference numeral and the same description will not be reiterated.

In the valve timing controller 43 of the third embodiment, the Inside diameter R2 of the opening 128 corresponding to the second reed part 185 is made smaller than the inside diameter R1 of the opening 129 corresponding to the first reed part 184. That is, the cross-sectional area of the opening 128 is smaller than the cross-sectional area of the opening 129.

The reed part 184, 185 is opened or closed according to the difference in the pressure of the working oil between the supply passage 30, 31 and the opening 128, 129. When the same quantity of working oil flows through the supply passages 30 and 31, the flow velocity of the working oil which flows through the opening 128 becomes high compared with the flow velocity of the working oil which flows through the opening 129.

Thereby, a variation in the flow velocity of the working oil before and after the second reed part 185 becomes larger than a variation in the flow velocity of the working oil before and after the first reed part 184, therefore a pressure difference before and after the reed part becomes large in the second reed part 185 compared with the first reed part 184. Thus, the second reed part 185 is opened earlier than the first reed part 184, and the same advantages can be obtained as the valve timing controller 41 of the first embodiment.

(Fourth Embodiment)

Figure 11:
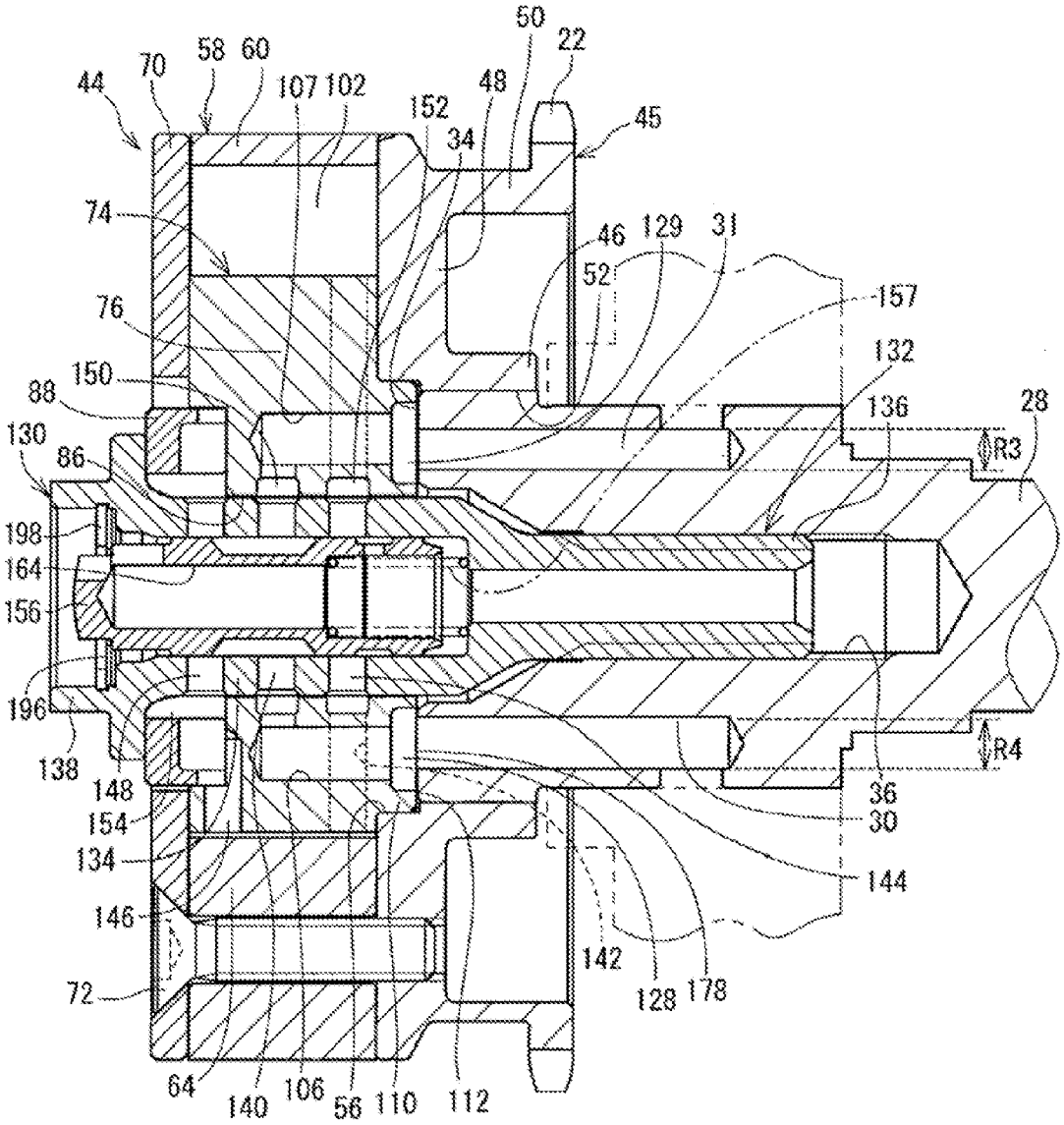
FIG. 11 is a cross-sectional view illustrating a part of a valve timing controller according to a fourth embodiment.

A valve timing controller 44 according to a fourth embodiment will be described with reference to FIG. 11. In the fourth embodiment, compared with the first embodiment, the inside diameter R4 of the supply passage 30 is made different from the inside diameter R3 of the supply passage 31. The substantially same parts and components as the first embodiment are indicated with the same reference numeral and the same description will not be reiterated.

In the valve timing controller 44 of the fourth embodiment, the inside diameter R4 of the supply passage 30 corresponding to the second reed part 185 is made larger than the inside diameter R3 of the supply passage 31. That is, the cross-sectional area of the supply passage 30 is larger than the cross-sectional area of the supply passage 31.

The reed part 184, 185 is opened or closed according to the difference in the pressure of the working oil between the supply passage 30, 31 and the opening 128, 129. When the same quantity of working oil flows through the supply passages 30 and 31, the amount of working oil flowing through the supply passage 30 is larger than the amount of working oil flowing through the supply passage 31.

Because higher pressure is applied to the second reed part 185 and because the pressure necessary for opening the second reed part 185 is smaller compared with the first reed part 184, the second reed part 185 is opened quickly, and working oil flows into the sleeve part 134 through the opening 128 and the supply passage 106. Therefore, the same advantages can be obtained as the valve timing controller 41 of the first embodiment.

(Other Embodiments)

In the above embodiments, the camshaft 28 has two supply passages 30, 31, and the vane rotor 74 has two openings 128, 129 and two supply passages 106, 107. However, the number of the supply passages or the openings is not limited to two, and may be more than two. In this case, the number of the reed parts formed in the reed valve is set to correspond to the number of the supply passages or the openings.

In the third embodiment, the inside diameter R2 of the opening 128 corresponding to the second reed part 185 is smaller than the inside diameter R1 of the opening 129 corresponding to the first reed part 184. However, the size relationship of the openings 128, 129 is not limited, while the cross-sectional area of the opening 128 corresponding to the second reed part 185 is smaller than the cross-sectional area of the opening 129 corresponding to the first reed part 184.

In the fourth embodiment, the inside diameter R4 of the supply passage 30 corresponding to the second reed part 185 is larger than the inside diameter R3 of the supply passage 31 corresponding to the first reed part 184. However, the size relationship of the supply passages 30, 31 is not limited, while the cross-sectional area of the supply passage 30 corresponding to the second reed part 185 is larger than the cross-sectional area of the supply passage 31 corresponding to the first reed part 184.

The present disclosure is not limited to the above embodiments.

Such changes and modifications are to be understood as being within the scope of the present disclosure as defined by the appended claims.

What is claimed is:

1. A method of assembling a valve timing controller that controls opening and closing timing of an intake valve or an exhaust valve in an internal combustion engine by controlling a rotation phase between a driving shaft and a driven shaft of the internal combustion engine, the valve timing controller comprising:

a first housing integrally rotating with the driving shaft and having a through hole through which the driven shaft passes;

second housing integrally rotating with the driving shaft and the first housing and having a pipe part and a bottom part, the first housing closing a first end of the pipe part, the bottom part closing a second end of the pipe part;

a vane rotor integrally rotating with the driven shaft and having a boss part and a vane part, the boss part being located inside the second housing, the vane part partitioning inside of the second housing into an advance chamber and a retard chamber, the vane rotor rotating on an advance side or a retard side relative to the second housing based on a pressure of working oil in the advance chamber and the retard chamber;

a plurality of first supply passages defined in the driven shaft and opening in an end surface of the driven shaft adjacent to the vane rotor;

a plurality of second slimly passages define in the vane rotor and opening in an end surface of the vane rotor adjacent to the first housing, the second supply passages respectively communicating with the first supply passages;

a sleeve having a cylindrical shape arranged on an inner side from the boss part in a radial direction, the sleeve having a supply port communicating with the second supply passages, an advance port communicating with the advance chamber, and a retard port communicating with the retard chamber;

a spool slidably moving in the sleeve in an axial direction among an advance position at which the supply port is connected to the advance port, a retard position at which the supply port is connected to the retard port, and a shutoff position at which the supply port is shutoff from the advance port, and the retard port; and a reed valve interposed between the end surface of the vane rotor and the end surface of the driven shaft, the reed valve having a fixed part and a plurality of reed parts, the fixed part having a plurality of holes that respectively connect the first supply passages to the corresponding second supply passages, each of the reed parts being formed to extend from an edge of the corresponding hole to cover the corresponding hole so as to open or close an open end of the corresponding first supply passage, the reed valve allowing the working oil to flow from the first supply passage to the second supply passage and prohibiting the working oil from flowing from the second supply passage to the first supply passage, wherein the plurality of reed. parts includes at least a first reed part and a second reed part, each of the first reed cart and the second reed part has each lower limit pressure for allowing the working, oil to flow from the first supply passage to the second supply passage, and the lower limit pressure of the first reed part is different from the lower limit pressure of the second reed part, the method comprising:

attaching the reed valve to the first housing to agree with the through hole of the first housing in a first process;

attaching the second housing, which receives the vane rotor inside, to the first housing in a second process;

inserting an end portion of the driven shaft into the through hole of the first housing in a manner that the reed valve is interposed between the end surface of the vane rotor and the end surface of the driven shaft in a third process; and inclining the second reed part before the third process relative to the read valve toward the end surface of the driven shaft.

2. The method of assembling a valve timing controller according to claim 1, wherein the first reed part has a length dimension larger than a length dimension of the second reed part.

3. The method of assembling a valve timing controller according to claim 1, wherein the plurality of second supply passages includes at least a third passage connected to the first reed part and a fourth passage connected to the second reed part, and the third passage has a cross-sectional area which is smaller than that of the fourth passage.

4. The method of assembling a valve timing controller according to claim 1, wherein the plurality of first supply passages includes at least a fifth passage connected to the first reed part and a sixth passage connected to the second reed part, and the fifth passage has a cross-sectional area which is larger than that of the sixth passage.

* * * * *